US009221263B2

(12) United States Patent
Suzuki

(10) Patent No.: US 9,221,263 B2
(45) Date of Patent: Dec. 29, 2015

(54) INKJET RECORDING DEVICE AND NOZZLE SURFACE WIPING METHOD FOR AN INKJET RECORDING DEVICE

(71) Applicant: SEIKO EPSON CORPORATION, Tokyo (JP)

(72) Inventor: Tomoji Suzuki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/685,576

(22) Filed: Apr. 13, 2015

(65) Prior Publication Data

US 2015/0246545 A1 Sep. 3, 2015

Related U.S. Application Data

(62) Division of application No. 13/643,322, filed as application No. PCT/JP2011/076469 on Nov. 10, 2011.

(30) Foreign Application Priority Data

Nov. 26, 2010 (JP) ..... 2010-263248
Nov. 30, 2010 (JP) ..... 2010-266220

(51) Int. Cl.
*B41J 2/165* (2006.01)

(52) U.S. Cl.
CPC ..... *B41J 2/16535* (2013.01)

(58) Field of Classification Search
None
See application file for complete search history.

(56) References Cited

U.S. PATENT DOCUMENTS

| | | | |
|---|---|---|---|
| 2006/0176346 | A1 | 8/2006 | Momose |
| 2009/0244170 | A1 | 10/2009 | Mikashima |

FOREIGN PATENT DOCUMENTS

| | | | |
|---|---|---|---|
| JP | 2001-253081 | A | 9/2001 |
| JP | 2004-34666 | A | 2/2004 |
| JP | 2004-195932 | A | 7/2004 |
| JP | 2007-296779 | A | 11/2007 |
| JP | 2008-183856 | A | 8/2008 |
| JP | 2009-226719 | A | 10/2009 |

OTHER PUBLICATIONS

International Search Report and Written Opinion mailed Jun. 20, 2012 in International Application No. PCT/JP2011/076469.

*Primary Examiner* — Alejandro Valencia
(74) *Attorney, Agent, or Firm* — Hauptman Ham, LLP

(57) ABSTRACT

An inkjet printer has a cap that covers the ink nozzle surface in which ink nozzles are formed when the inkjet head is at a inkjet head standby position; an ink absorber that is held inside the cap and absorbs ink ejected from the ink nozzles into the cap; a water discharge head that seals the cap with a water nozzle surface in which water nozzles are formed when the inkjet head is at the printing position; and a suction pump for discharging water from the water discharge head when the water discharge head seals the cap.

4 Claims, 8 Drawing Sheets

INKJET RECORDING DEVICE AND NOZZLE SURFACE WIPING METHOD FOR AN INKJET RECORDING DEVICE

RELATED APPLICATIONS

The present invention is a divisional of U.S. patent application Ser. No. 13/643,322 filed Oct. 25, 2012 which is a National Phase of International Application No. PCT/JP2011/076469, filed Nov. 10, 2011, and claims priorities from Japanese Application Numbers 2010-266220, filed Nov. 30, 2010 and 2010-263248, filed Nov. 26, 2010. The disclosures of all of the above-listed prior-filed applications are hereby incorporated by reference herein in their entirety.

TECHNICAL FIELD

The present invention relates to an inkjet recording device having a cap that covers the ink nozzle surface of an inkjet head when an ink absorbing material is inside and the inkjet head is in a standby position.

BACKGROUND ART

In order to prevent the ink nozzles from clogging due to increased ink viscosity in the ink nozzles, the ink nozzle surface in which the ink nozzles are formed is covered with a cap while the inkjet head is in the standby position to prevent the evaporation of moisture from the ink nozzles. Flushing, in which the ink nozzle surface is positioned opposite the cap and ink is discharged from the ink nozzles into the cap, is also performed regularly to prevent clogging. In addition, when an ink nozzle becomes clogged, the ink nozzle surface is covered with the cap, negative pressure is produced by a suction pump in the closed space formed by the nozzle surface and the cap to forcibly expel ink from the ink nozzle into the cap in an ink suction operation that eliminates the clogging. The ink that is expelled from the ink nozzles in the flushing operation and the ink suction operation is absorbed by an ink absorber such as a felt sponge held inside the cap.

The ink discharged from the ink nozzles contains a moisture retention agent such as glycerine, and the moisture retention agent accumulates in the ink absorber as the flushing operation and suction operation are performed. Because the cap does not cover the ink nozzle surface and is open while the inkjet head is printing, moisture evaporates from the ink absorber and the balance between moisture and the moisture retention agent in the cap is lost. Ink nozzle clogging occurs more easily when this balance between the moisture and the moisture retention agent is disrupted because the moisture retention agent attracts moisture from the closed space formed by the cap and the ink nozzle surface when the cap covers the ink nozzle surface, thus accelerating the evaporation of moisture from the ink nozzles and helping to increase the ink viscosity. An inkjet printer that has a cap sealing member, which has a liquid nozzle surface in which liquid nozzles that eject a moisturizing liquid are formed, and supplies moisture into the cap by discharging moisturizing liquid from the liquid nozzles into the cap while the cap is covered by the liquid nozzle surface of the cap sealing member, is described in Patent Literature 1.

CITATION LIST

Patent Literature

PTL 1: Japanese Unexamined Patent Appl. Pub. JP-A-2009-226719

SUMMARY OF INVENTION

Technical Problem

However, because the cap is left open for an extended period of time during continuous printing, evaporation of moisture from the ink absorber cannot be suppressed and the balance between the amount of moisture retention agent and moisture inside the cap is disrupted even when a supply mechanism is used to supply moisture into the cap.

If the printing with the inkjet head stops immediately after moisturizing liquid is discharged from the cap sealing member into the cap, the cap moves from where it is covered by the cap sealing member to where it covers the ink nozzle surface of the inkjet head in conjunction with the inkjet head moving to the standby position. As a result, the liquid nozzle surface of the cap sealing member is exposed while still wet and the moisturizing liquid may drip from the exposed surface of the liquid nozzles. Moisturizing liquid that drips from the liquid nozzle surface then wets the inside of the printer or the print medium.

With consideration for these problems, an object of the present invention is to provide an inkjet recording device that can maintain a specific moisturized state inside a cap that contains an ink absorber.

Another object of the invention is to provide an inkjet recording device that can prevent moisturizing liquid from dripping from the liquid nozzle surface in which liquid nozzles are formed and wetting the inside of the recording device even when the cap is moved immediately after discharging moisturizing liquid from the liquid nozzles and supplying moisture into the cap.

Yet another object of the invention focuses on the liquid nozzle surface of the cap sealing member being exposed while wet, and provides a method of wiping the ink nozzle surface of an inkjet recording device that prevents the ink nozzles becoming clogged when the ink nozzle surface is wiped.

Solution to Problem

The invention is directed to solving at least part of the problem described above, and can be embodied as described in the following examples.

Example 1

An inkjet recording device characterized by comprising: an inkjet head that can move between a printing position where printing on a print medium is possible, and a standby position separated from the printing position; a cap that covers the ink nozzle surface of the inkjet head in which an ink nozzle is formed when the inkjet head is in the standby position; an ink absorber that is held inside the cap and absorbs ink discharged from the ink nozzle to the cap; a cap sealing member that seals the cap when the inkjet head is in the printing position; and a liquid supply mechanism that supplies a moisturizing liquid to the inside of the cap.

With this configuration, when the inkjet head is in the standby position, the cap can be sealed by covering the ink nozzle surface with the cap. In addition, when the inkjet head is in the printing position, that is, while printing with the inkjet head, the cap is sealed by the cap sealing member. As a result, evaporation of moisture from the ink absorber can be suppressed because leaving the cap open for a long time can be avoided. In addition, the inside of the cap can be kept moist because the ink absorber can be made to absorb moisture by means of the liquid supply mechanism supplying a moisturizing liquid to the inside of the cap. The moisture retention agent accumulated in the ink absorber taking moisture from the sealed spaced formed by the cap and the ink nozzle surface when the cap covers the ink nozzle surface, accelerating evaporation of moisture from the ink nozzles, promoting increased ink viscosity, and causing the ink nozzles to clog, can be prevented.

Example 2

The inkjet recording device described above, characterized by: the cap sealing member having a liquid nozzle surface in which a liquid nozzle for discharging a moisturizing liquid is formed, and sealing the cap in a sealed position by means of the liquid nozzle surface; and the liquid supply mechanism comprising a liquid tank disposed above the liquid nozzle, a liquid supply path that connects the liquid tank and the liquid nozzle, a valve element that is positioned in the liquid supply path and closes the liquid supply path in resistance to the hydraulic head of the liquid, and a suction pump that produces negative pressure in a first sealed space that is formed by the liquid nozzle surface and the cap when the cap is sealed by the liquid nozzle surface, drives the valve element, opens the liquid supply path, and discharges the liquid from the liquid nozzle.

This aspect of the invention can supply liquid to the inside of the cap from the cap sealing member by means of a simple configuration. Moisture retention agent that has accumulated in the ink absorber from inside the cap can also be discharged by suction from the suction pump.

Example 3

The inkjet recording device described above, characterized by the valve element being mounted on the cap sealing member.

This configuration can shorten the distance from the liquid nozzle to the valve element, and limit evaporation of the moisturizing liquid that evaporates from the liquid nozzle surface to the volume from the liquid nozzle surface to the valve element. Consumption of the moisturizing liquid can therefore be reduced.

Example 4

The inkjet recording device described above, characterized by the suction pump producing negative pressure in a second sealed space that is formed by the ink nozzle surface and the cap, and discharging ink from the ink nozzle, when the cap is covering the ink nozzle surface.

This configuration helps reduce device size and suppress the production cost by using a single suction pump to perform the ink suction operation that forcibly expels ink from the ink nozzles into the cap when ink nozzle clogging occurs, and to supply liquid into the cap from the cap sealing member.

Example 5

The inkjet recording device described above, characterized by comprising a cap moving mechanism that moves the cap between a capping position covering the ink nozzle surface when the inkjet head is in the standby position, and the sealed position where the cap is sealed by the cap sealing member; and a cap moving control unit that moves the cap to the sealed position and seals the cap by means of the cap sealing member when the inkjet head moves to the printing position, and moves the cap to the capping position and covers the ink nozzle surface by means of the cap when the inkjet head moves to the standby position.

With this configuration, the ink nozzle surface of the inkjet head can be covered by the cap when the inkjet head is in the standby position, and the cap can be easily sealed by the cap sealing member when the inkjet head is in the printing position.

Example 6

An inkjet recording device characterized by comprising: an inkjet head that can move between a printing position where printing on a print medium is possible, and a standby position separated from the printing position; a cap that covers the ink nozzle surface of the inkjet head in which an ink nozzle is formed when the inkjet head is in the standby position; an ink absorber that is held inside the cap and absorbs ink discharged from the ink nozzle to the cap; a cap sealing member that has a liquid nozzle surface in which a liquid nozzle for discharging a moisturizing liquid is formed, and seals the cap by means of the liquid nozzle surface when the inkjet head is in the printing position; a liquid supply mechanism that discharges the moisturizing liquid from the liquid nozzle and moisturizes the ink absorber when the cap is sealed by the cap sealing member; and a wiper mechanism that wipes the liquid nozzle surface by means of a wiper blade.

When the printing operation of the inkjet head ends immediately after moisturizing liquid is discharged into the cap from the liquid nozzle of the cap sealing member, and the cap moves from the position covered by the cap sealing member to the position covering the ink nozzle surface of the inkjet head, this configuration enables wiping the liquid nozzle surface of the cap sealing member by means of the wiping mechanism and removing the moisturizing liquid. Moisturizing liquid dripping from the liquid nozzle surface and wetting the inside of the device can therefore be prevented.

Example 7

The inkjet recording device described above, characterized by the wiper mechanism wiping the ink nozzle surface of the inkjet head by means of the wiper blade.

This configuration helps reduce device size and suppress the production cost by using a single wiper mechanism to wipe the ink nozzle surface of the inkjet head and to wipe the liquid nozzle surface of the cap sealing member.

Example 8

The inkjet recording device described above, characterized by comprising a wiper mechanism moving mechanism that moves the wiper mechanism between a first position where wiping the liquid nozzle surface of the cap sealing member is possible, and a second position where wiping the ink nozzle surface of the inkjet head is possible.

This configuration enables wiping the liquid nozzle surface of the cap sealing member and the ink nozzle surface of the inkjet head by means of the wiping mechanism.

Example 9

The inkjet recording device described above, characterized by comprising: a cap moving mechanism that moves the cap between a capping position covering the ink nozzle surface of the inkjet head, and a sealed position where the cap is sealed by the cap sealing member; and a control unit that controls driving the cap moving mechanism, the liquid supply mechanism, the wiper mechanism, and the wiper mechanism moving mechanism; wherein the control unit consecutively performs in order moving the cap to the sealed position, discharging the moisturizing liquid from the liquid nozzle, moving the wiper mechanism to the first position, wiping the liquid nozzle surface by means of the wiper blade, moving the wiper mechanism to the second position, and wiping the ink nozzle surface by means of the wiper blade.

In the wiping operation that wipes the ink nozzle surface of the inkjet head in this configuration, moisturizing liquid is first discharged from the liquid nozzle to wet the liquid nozzle surface, and the wet liquid nozzle surface is then wiped by the wiper blade. As a result, even if viscous ink that has increased in viscosity on the wiper blade as a result of a wiping operation previously performed to wipe the ink nozzle surface, the wiper blade is cleaned by the moisturizing liquid when the liquid nozzle surface is wiped, and the viscous ink is removed from the wiper blade. Viscous ink on the wiper blade will therefore not be pushed into the ink nozzles and ink nozzles will not be clogged when the ink nozzle surface is wiped.

Example 10

An ink nozzle surface wiping method for an inkjet recording device that is an ink nozzle surface wiping method for the inkjet recording device described above, characterized by: sealing the cap by means of the liquid nozzle surface of the cap sealing member; discharging the liquid from the liquid nozzle; wiping the liquid nozzle surface of the cap sealing member by means of the wiper blade; and wiping the ink nozzle surface of the inkjet head by means of the wiper blade.

Example 11

The ink nozzle surface wiping method for an inkjet recording device described above, characterized by: moving the cap between a capping position covering the ink nozzle surface of the inkjet head, and a sealed position where the cap is sealed by the cap sealing member; and performing in order moving the cap to the sealed position, discharging the moisturizing liquid from the liquid nozzle, moving the wiper mechanism to the first position, wiping the liquid nozzle surface by means of the wiper blade, moving the wiper mechanism to the second position, and wiping the ink nozzle surface by means of the wiper blade.

In the wiping operation that wipes the ink nozzle surface of the inkjet head according to this method, moisturizing liquid is first discharged from the liquid nozzle to wet the liquid nozzle surface, and the wet liquid nozzle surface is then wiped by the wiper blade. As a result, even if viscous ink that has increased in viscosity on the wiper blade as a result of a wiping operation previously performed to wipe the ink nozzle surface, the wiper blade is cleaned by the moisturizing liquid when the liquid nozzle surface is wiped, and the viscous ink is removed from the wiper blade. Viscous ink on the wiper blade will therefore not be pushed into the ink nozzles and ink nozzles will not be clogged when the ink nozzle surface is wiped.

Advantageous Effects of Invention

With this invention, when the inkjet head is in the standby position, the cap can be sealed by covering the ink nozzle surface with the cap. In addition, when the inkjet head is in the printing position, that is, while printing with the inkjet head, the cap is sealed by the cap sealing member. As a result, evaporation of moisture from the ink absorber can be suppressed by avoiding leaving the cap open for along time. In addition, the inside of the cap can be kept moist by causing the ink absorber to absorb moisture by means of the liquid supply mechanism supplying a moisturizing liquid to the inside of the cap. The moisture retention agent accumulated in the ink absorber taking moisture from the sealed spaced formed by the cap and the ink nozzle surface when the cap covers the ink nozzle surface, accelerating evaporation of moisture from the ink nozzles, promoting increased ink viscosity, and causing the ink nozzles to clog, can be prevented.

When the printing operation of the inkjet head ends immediately after moisturizing liquid is discharged into the cap from the liquid nozzle of the cap sealing member, and the cap moves from the position covered by the cap sealing member to the position covering the ink nozzle surface of the inkjet head, the inkjet recording device according to the invention enables wiping the liquid nozzle surface of the cap sealing member by means of the wiping mechanism and removing the moisturizing liquid. Moisturizing liquid dripping from the liquid nozzle surface and wetting the inside of the device can therefore be prevented.

In the wiping operation that wipes the ink nozzle surface of the inkjet head, the ink nozzle surface wiping method of an inkjet recording device according to the invention first discharges moisturizing liquid from the liquid nozzle to wet the liquid nozzle surface, and then wipes the wet liquid nozzle surface with the wiper blade. As a result, even if viscous ink that has increased in viscosity on the wiper blade as a result of a wiping operation previously performed to wipe the ink nozzle surface, the wiper blade is cleaned by the moisturizing liquid when the liquid nozzle surface is wiped, and the viscous ink is removed from the wiper blade. Viscous ink on the wiper blade will therefore not be pushed into the ink nozzles and ink nozzles will not be clogged when the ink nozzle surface is wiped.

DESCRIPTION OF EMBODIMENTS

An inkjet printer is described below as an example of an inkjet recording device according to the invention with reference to the accompanying figures. Note that the horizontal and vertical scale of members and parts may differ from the actual scale for ease of description and illustration in the figures referenced in the following description of the invention.

General Configuration of an Inkjet Printer

Figure 1:
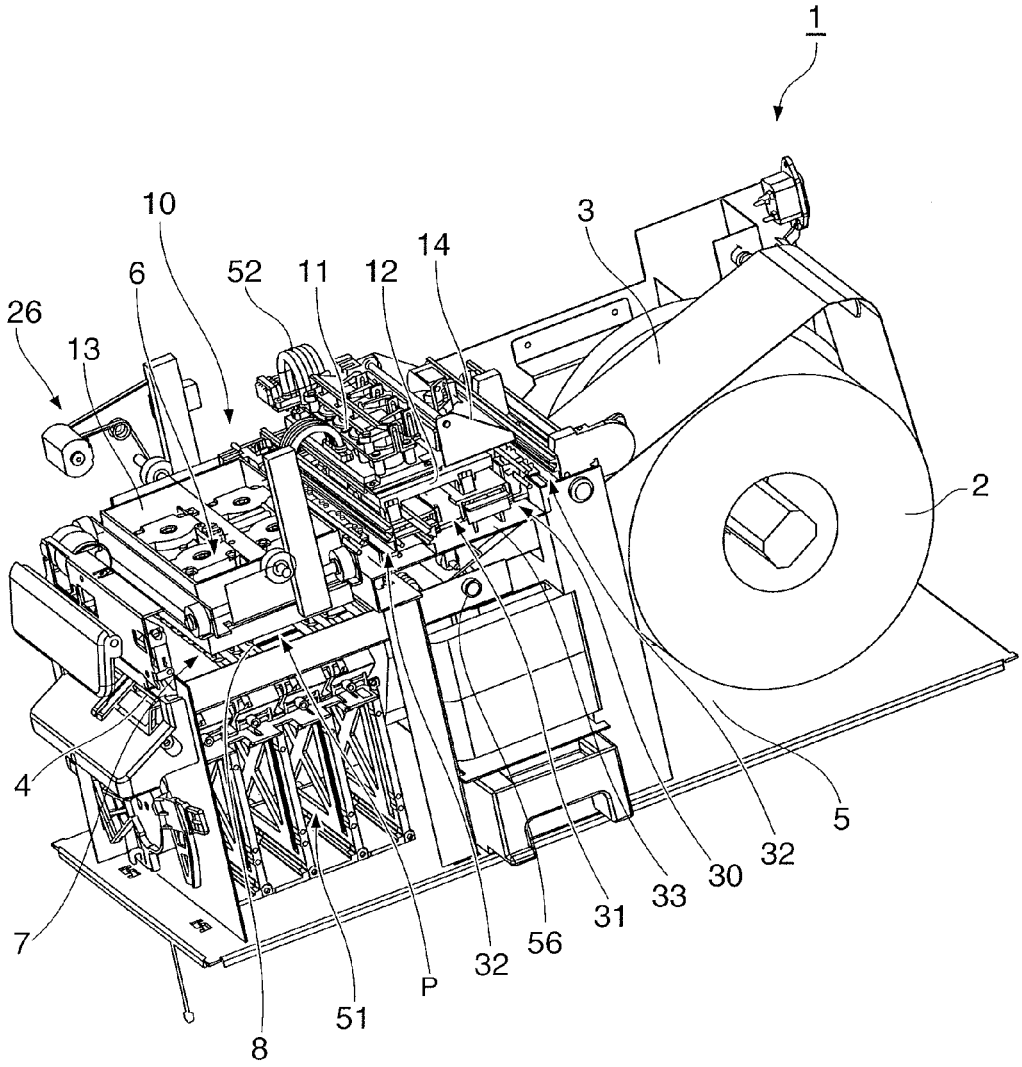
FIG. 1 is an oblique view of an inkjet printer with the printer case removed.
Figure 2A:
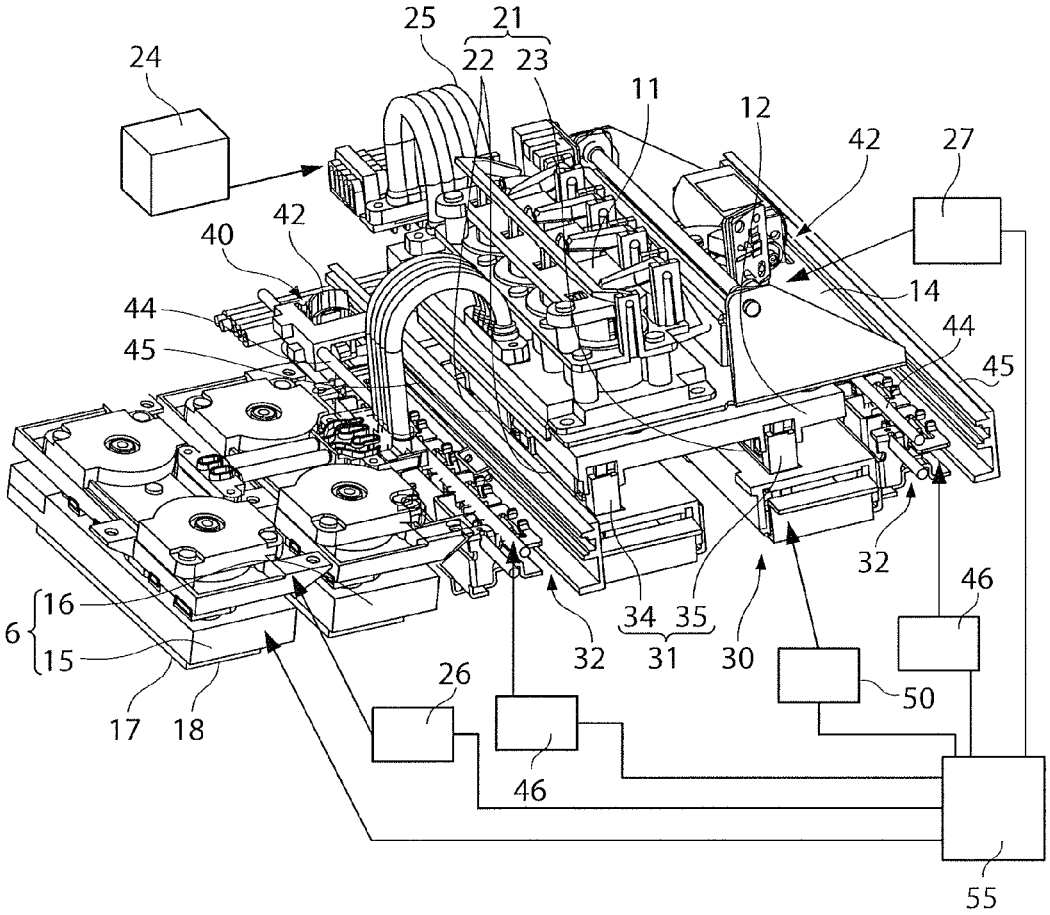
FIG. 2A is an oblique view of the head unit and the maintenance unit and FIG. 2B is a section view of the cap.
Figure 2B:
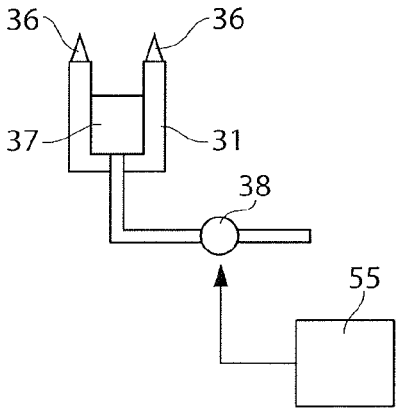

The general configuration of an inkjet printer according to this embodiment of the invention is described first below with reference to FIG. 1 and FIG. 2. FIG. 1 is an oblique view of an inkjet printer with the printer case removed. FIG. 2 is a section view of the head unit and the maintenance unit, FIG. 2A being an oblique view of main parts of the head unit and the maintenance unit, and FIG. 2B being a section view of the cap.

The inkjet printer 1 uses plural colors of ink to print on a web of recording paper 3 delivered from a paper roll 2. The inkjet printer 1 is basically shaped like a rectangular box with a recording paper exit 4 formed in the front. A roll paper compartment 5 is formed in the back of the inkjet printer 1, and the recording paper 3 delivered from the paper roll 2 loaded in the roll paper compartment 5 is conveyed toward the printer front along a recording paper conveyance path 7 that passes the printing position P of an inkjet head 6. The printing position P is determined by a platen 8.

A head unit 10 is disposed above the platen 8. The head unit 10 includes the inkjet head 6, a pump mechanism 11 for supplying ink to the inkjet head 6, and a water discharge head (cap sealing member) 12 that ejects water (a moisturizer). The head unit 10 also includes a first carriage 13 that carries the inkjet head 6, and a second carriage 14 that carries the pump mechanism 11 and water discharge head 12 and is located towards the back of the printer relative to the first carriage 13.

As shown in FIG. 2A, the inkjet head 6 includes a first inkjet head 15 and a second inkjet head 16 that is located towards the back of the printer relative to the first inkjet head 15. The first inkjet head 15 and second inkjet head 16 are identically structured, and are both disposed with the ink nozzle surface 18 in which the ink nozzles 17 are formed facing down.

The water discharge head 12 is located on the second carriage 14 below the pump mechanism 11. The water discharge head 12 is mounted on the second carriage 14 with the water nozzle surface (liquid nozzle surface) 21 in which water nozzles (liquid nozzles) 20 for discharging water (see FIG. 3) are formed facing down. The water nozzle surface 21 includes a first water nozzle surface 22 and a second water nozzle surface 23 positioned toward the back of the printer from the first water nozzle surface 22. A water tank (liquid tank) 24 is connected to the water discharge head 12 through a water supply line 25. The water tank 24 is located higher than the water discharge head 12.

The first carriage 13 is moved vertically by a first carriage moving mechanism 26. The second carriage 14 is moved vertically by a second carriage moving mechanism 27.

The first carriage moving mechanism 26 moves the inkjet head 6 between a printing position 6A, an inkjet head standby position 6B, and an inkjet head wiping position 6C. The printing position 6A is a position where the inkjet head 6 is opposite the recording paper 3 with a specific gap therebetween and can print on the recording paper 3 as it passes over the platen 8. The inkjet head standby position 6B is a position where the inkjet head 6 idles when the inkjet printer 1 is asleep or is in a standby state waiting for print data to be supplied from a host computer. The inkjet head wiping position 6C is the position for wiping the ink nozzle surface 18 of the inkjet head 6 (see FIG. 4).

The second carriage moving mechanism 27 moves the water discharge head 12 vertically between the water discharge head standby position 12A and water discharge head wiping position 12B. The water discharge head 12 is normally positioned to the water discharge head standby position 12A. The water discharge head wiping position 12B is the position for wiping the water nozzle surface 21 of the water discharge head 12 (see FIG. 5).

A maintenance unit 30 is disposed in a space formed between the head unit 10 and the conveyance path 7 below the second carriage 14. As shown in FIG. 2A, the maintenance unit 30 includes a box-shaped cap 31 with a top opening, a wiper mechanism 32 disposed on both sides of the cap 31 in the front-back direction of the printer, and a maintenance unit carriage 33 that carries the cap 31 and wiper mechanism 32.

The cap 31 includes a first cap 34 that covers the first inkjet head 15 in the inkjet head standby position 6B, and an identically constructed second cap 35 that covers the second inkjet head 16. As shown in FIG. 2B, the first cap 34 and second cap 35 have a surrounding lip 36 made of butyl rubber, for example, disposed around the open edge. An ink absorber 37 made from a felt sponge, for example, is held inside the cap 31. A suction pump 38 is connected to the cap 31.

The wiper mechanism 32 includes a first wiper mechanism 40 for wiping the ink nozzle surface 18 of the first inkjet head 15 and the first water nozzle surface 22 of the water discharge head 12, and a second wiper mechanism 41 for wiping the ink nozzle surface 18 of the second inkjet head 16 and the second water nozzle surface 23 of the water discharge head 12. The first wiper mechanism 40 and second wiper mechanism 41 are disposed symmetrically with the cap 31 therebetween.

The wiper mechanism 32 includes a wiper blade 42 for wiping the ink nozzle surface 18 of the inkjet head 6 and the water nozzle surface 21 of the water discharge head 12; a wiper blade carriage 43 that carries the wiper blade 42; a guide shaft 44 and guide channel 45 that guide movement of the wiper blade carriage 43; and a wiper moving mechanism 46 that moves the wiper blade carriage 43 along the guide shaft 44 and guide channel 45. The wiper blade 42 is made from rubber or other elastic material. The guide shaft 44 and guide channel 45 extend widthwise to the printer. The wiper moving mechanism 46 moves the wiper blade 42, which normally waits at a position removed widthwise to the printer from the ink nozzle surface 18 and water nozzle surface 21, widthwise to the printer by causing the wiper blade carriage 43 to move along the guide shaft 44 and guide channel 45.

The maintenance unit carriage 33 is moved in the front-back direction of the printer by the maintenance unit carriage moving mechanism (wiper mechanism moving mechanism, cap moving mechanism) 50. As a result, the maintenance unit 30 moves in the front-back direction of the printer through the space formed between the head unit 10 and conveyance path 7. More specifically, the maintenance unit 30 moves from the front of the printer between a first maintenance position (second position) 30A where the second wiper mechanism 41 is positioned directly below the second inkjet head 16; a second maintenance position 30B where the cap 31 is at a capping position 31A directly below the ink nozzle surface 18 of the inkjet head 6; a third maintenance position (second position) 30C where the first wiper mechanism 40 is positioned directly below the ink nozzle surface 18 of the first inkjet head 15; a fourth maintenance position (first position) 30D where the second wiper mechanism 41 is positioned directly below the second water nozzle surface 23 of the water discharge head 12; a fifth maintenance position 30E where the cap 31 is in a sealed position 31B directly below the water nozzle surface 21 of the water discharge head 12; and a sixth maintenance position (first position) 30F where the first wiper mechanism 40 is positioned directly below the first water nozzle surface 22 of the water discharge head 12 (see FIG. 4 to FIG. 6).

The capping position 31A is the position where the cap 31 covers the ink nozzle surface 18 when the inkjet head 6 is in the inkjet head standby position 6B. The sealed position 31B is the position where cap 31 is sealed by the water discharge head 12 set to the water discharge head standby position 12A.

Next, as shown in FIG. 1, an ink cartridge loading unit 51 is disposed below the platen 8. Four ink cartridges respectively storing cyan, magenta, yellow, and black ink, for example, are installed to the ink cartridge loading unit 51. When ink cartridges are installed to the ink cartridge loading unit 51, the ink tanks are connected to the pump mechanism 11 through an ink supply line 52, and ink can be supplied to the inkjet head 6.

As shown in FIG. 2A, the inkjet printer 1 also has a control unit (cap movement control unit) 55 that prints on the recording paper 3 based on print commands from a host computer, for example. The control unit 55 conveys the recording paper 3 supplied from the paper roll 2 through the conveyance path 7 by means of a recording paper conveyance mechanism including a paper feed roller 56 (see FIG. 1) while controlling driving the pump mechanism 11 and inkjet head 6 to print on the recording paper 3 as it passes the printing position P. The control unit 55 also controls synchronously driving the first carriage moving mechanism 26, second carriage moving mechanism 27, wiper moving mechanism 46, suction pump 38, and maintenance unit carriage moving mechanism 50.

Water Discharge Head

Figure 3A:
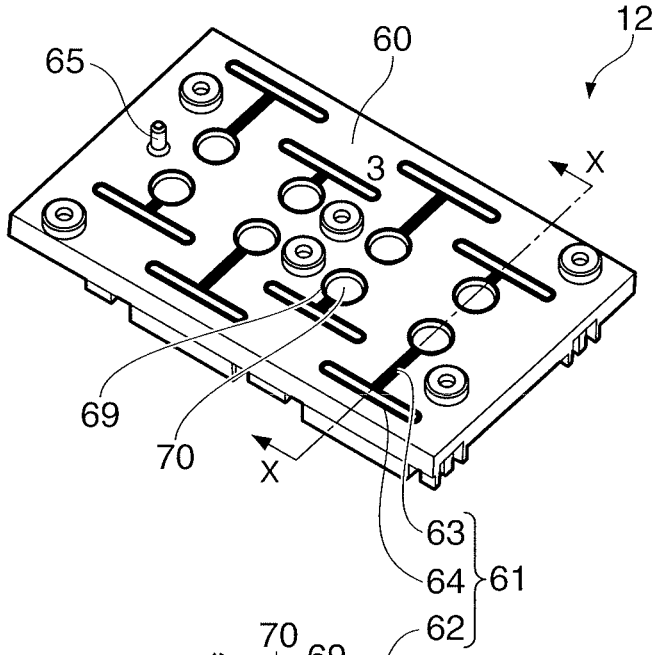
FIG. 3A is a top perspective view of a fluid ejection head.
Figure 3B:
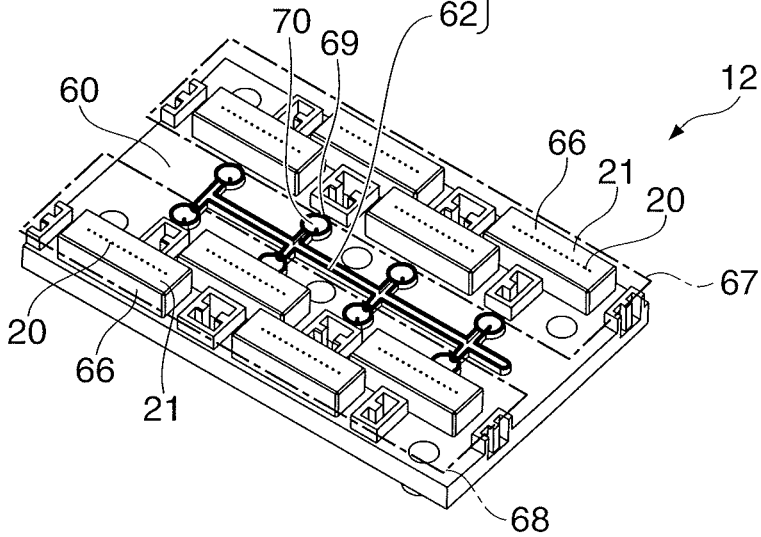
FIG. 3B is a bottom perspective view of the fluid ejection head.
Figure 3C:
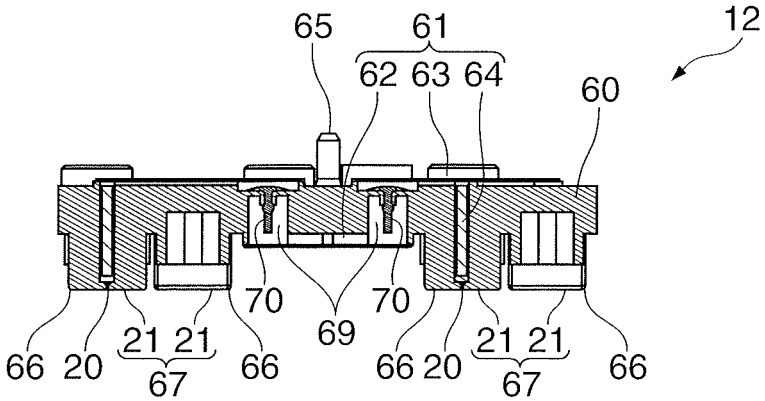
FIG. 3C is a section view of the fluid ejection head taken along line X-X in FIG. 3A.

The water discharge head 12 is described next with reference to FIG. 3. FIG. 3 is an oblique view and a section view of the water discharge head, FIG. 3A being an oblique view of the water discharge head 12 from diagonally above, FIG. 3B being an oblique view of the water discharge head 12 from diagonally below, and FIG. 3C being a section view of the water discharge head 12 through line X-X in FIG. 3A.

As shown in FIG. 3, the water discharge head 12 has a rectangular panel 60. A water channel 61 for supplying water to the water nozzles 20 is formed inside the panel 60. The water channel 61 includes a main line 62 that extends widthwise to the printer at a position near the bottom of the panel 60, a plurality of branch lines 63 that extend in the front-back direction of the printer at a position near the top of the panel 60, and a channel 64 that descends from the front or back distal end of a branch line 63.

As shown in FIG. 3A, an inlet tube 65 to which the water supply line 25 from the water tank 24 is connected is formed in the top surface of the panel 60, and this inlet tube 65 communicates with the main line 62 of the water channel 61. As shown in FIG. 3B, eight rectangular protuberances 66 are formed on the bottom of the panel 60, and the bottoms of the protuberances 66 are the water nozzle surfaces 21 in which a plurality of water nozzles 20 are formed. The water nozzles 20 communicate with the branch lines 63 through the channels 64.

Of these eight protuberances 66, the water nozzle surfaces 21 of the four protuberances 66 positioned at the front side of the printer render a first nozzle surface 67, and the water nozzle surfaces 21 of the four protuberances 66 positioned at the back side of the printer render a second nozzle surface 68. The location of the first nozzle surface 67 corresponds to the four ink nozzle surfaces 18 of the first inkjet head 15, and the location of the second nozzle surface 68 corresponds to the four ink nozzle surfaces 18 of the second inkjet head 16.

A valve chamber 69 that extends vertically and connects the main line 62 and the branch lines 63 is formed between the main line 62 and branch lines 63 of the water channel 61. An elastic, barrel-shaped valve element 70 is disposed in the valve chamber 69. The valve element 70 closes the water channel 61 in resistance to the hydraulic head of the water stored in the water tank 24, and is driven to open the water channel 61 and discharge water from the water nozzles 20 when a specific negative pressure is produced on the water nozzle 20 side of the valve element 70.

Therefore, to discharge water from the water nozzles 20, the water nozzle surface 21 of the water discharge head 12 is covered by the cap 31, and the suction pump 38 is driven to produce negative pressure inside the sealed space between the cap 31 and the water nozzle surface 21. More specifically, the fluid supply path composed of the water tank 24, water supply line 25, and water channel 61, the valve element 70, and the suction pump 38 render a fluid supply mechanism for supplying water into the cap 31.

Changing to the Printing State and the Standby State

The operations whereby the inkjet printer 1 transitions to the printing state and the standby state, and more specifically how the control unit 55 controls driving the first carriage moving mechanism 26, the second carriage moving mechanism 27, the wiper moving mechanism 46, the suction pump 38, and the maintenance unit carriage moving mechanism 50 in these transitions, are described next with reference to FIG. 4. FIG. 4 shows the positions of the head unit 10 and the maintenance unit 30 in the printing state and the standby state.

Figure 4A:
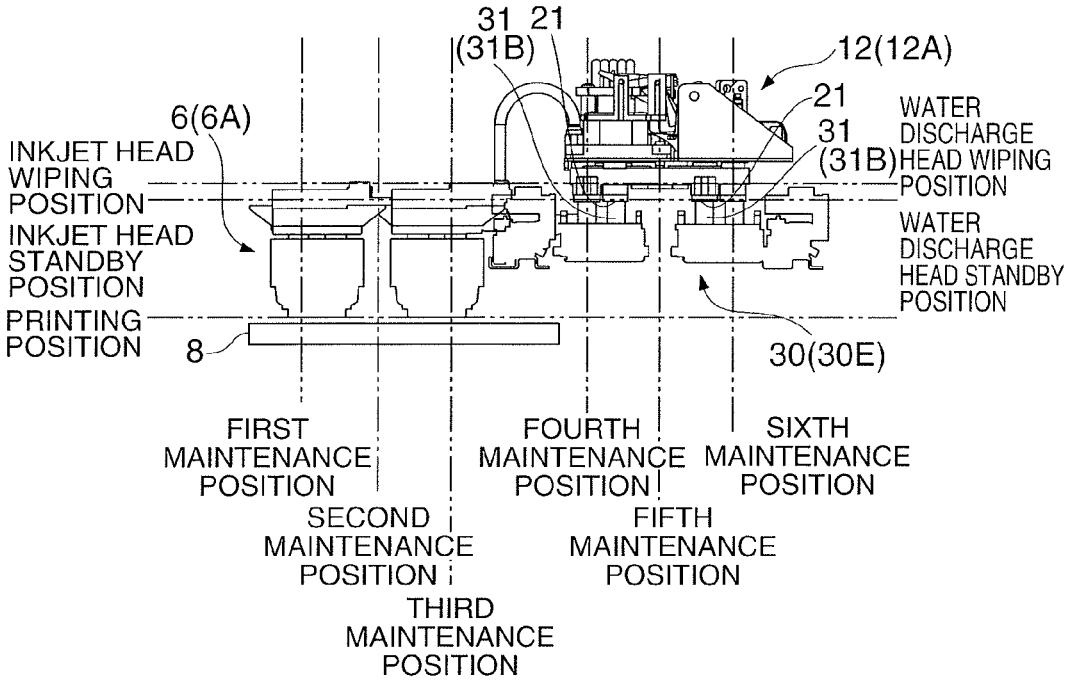
FIG. 4A shows the position of the head unit and maintenance unit while printing and FIG. 4B shows the position of the head unit and maintenance unit when in the standby state.

As shown in FIG. 4A, when performing the printing operation that prints on the recording paper 3, the control unit 55 drives the maintenance unit carriage moving mechanism 50 to move the maintenance unit 30 to the fifth maintenance position 30E, and positions the cap 31 to the sealed position 31B directly below the water nozzle surface 21 of the water discharge head 12. The control unit 55 also drives the first carriage moving mechanism 26 and positions the inkjet head 6 to the printing position 6A. In addition, the control unit 55 drives the second carriage moving mechanism 27 and positions the water discharge head 12 to the water discharge head standby position 12A.

The sealed position 31B is the position where the water discharge head 12 set to the water discharge head standby position 12A is sealed by the cap 31. At the sealed position 31B the water nozzle surface 21 of the water discharge head 12 elastically contacts the lip 36 of the cap 31 and seals the top opening of the cap 31. As a result, the cap 31 is sealed by the water discharge head 12 when the inkjet head 6 is in the printing position 6A, that is, while printing is in progress.

Figure 4B:
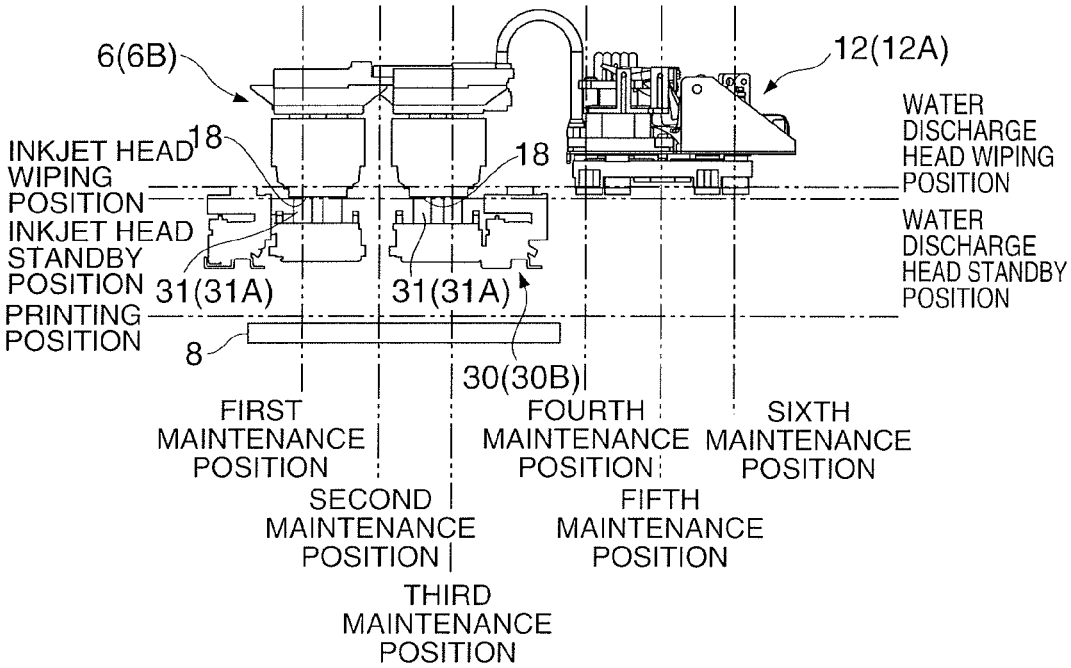

When printing ends, the control unit 55 drives the first carriage moving mechanism 26 and positions the inkjet head 6 to the inkjet head standby position 6B as shown in FIG. 4B. The control unit 55 also drives the maintenance unit carriage moving mechanism 50 and moves the maintenance unit 30 to the second maintenance position 30B, and positions the cap 31 to the capping position 31A directly below the ink nozzle surface 18 of the inkjet head 6.

When the cap 31 is positioned to the capping position 31A, the lip 36 of the cap 31 elastically contacts the ink nozzle surface 18 of the inkjet head 6 in the standby position, resulting in the cap 31 covering the ink nozzle surface 18. Therefore, while the inkjet printer 1 is in the standby state or sleep state waiting for print data to be supplied from a host computer, for example, the ink nozzle surface 18 of the inkjet head in the standby position is covered by the cap 31.

Ink Suction Operation

The ink suction operation whereby ink is forcibly discharged from the ink nozzles 17 when ink nozzle 17 clogging occurs is described next.

When the ink suction operation is performed, the control unit 55 drives the first carriage moving mechanism 26 and sets the inkjet head 6 to the inkjet head standby position 6B. The control unit 55 also drives the maintenance unit carriage moving mechanism 50 to move the maintenance unit 30 to the second maintenance position 30B and set the cap 31 to the capping position 31A, resulting in the cap 31 covering the ink nozzle surface 18. The control unit 55 then drives the suction pump 38, producing negative pressure in the sealed space formed by the ink nozzle surface 18 and cap 31, and forcibly discharging ink from the ink nozzles 17 to the cap 31. The position at which the head unit 10 and maintenance unit 30 perform this ink suction operation is the same as the standby position shown in FIG. 4B.

Water Supply Operation

The water supply operation that supplies water into the cap 31 in order to moisturize the ink absorber 37 stored in the cap 31 is described next with reference to FIG. 5. FIG. 5 describes the positions of the head unit 10 and the maintenance unit 30 in the water supply operation.

Figure 5A:
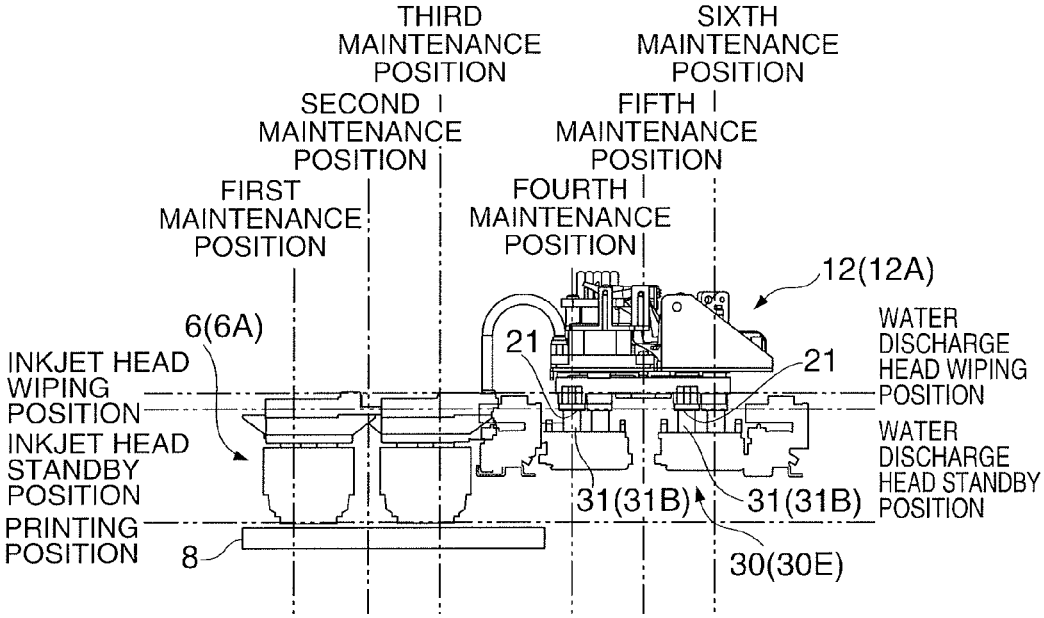
FIG. 5A, FIG. 5B, FIG. 5C, and FIG. 5D describe movements of the head unit and the maintenance unit during the water supply operation.

To perform the water supply operation, the control unit 55 drives the maintenance unit carriage moving mechanism 50 to move the maintenance unit 30 to the fifth maintenance position 30E and position the cap 31 to the sealed position 31B directly below the water nozzle surface 21 of the water discharge head 12 as shown in FIG. 5A. The control unit 55 also drives the second carriage moving mechanism 27 and sets the water discharge head 12 to the water discharge head standby position 12A. As a result, the cap 31 is sealed by the water nozzle surface 21. The control unit 55 then drives the suction pump 38 to produce negative pressure in the sealed space formed by the water nozzle surface 21 and cap 31, and discharges water from the water nozzles 20 to the cap 31. Because the state in which the water nozzle surface 21 seals the top opening to the cap 31 is the same as the printing state shown in FIG. 4A, this water supply operation usually occurs while printing. The moisturizer accumulated in the ink absorber 37 is also discharged from the cap 31 by the suction produced by the suction pump 38 during this water supply operation.

If printing ends immediately after the water supply operation, the maintenance unit 30 moves from the fifth maintenance position 30E to the second maintenance position 30B shown in FIG. 4B, and the cap 31 moves from the sealed position 31B to the capping position 31A directly below the inkjet head 6. When this happens, water left inside the water nozzles 20 could drip down from the water nozzle surface 21 and wet the recording paper 3 on the conveyance path 7. Therefore, when printing ends before a specified time has passed after the water supply operation, the wiping operation in which the water nozzle surface 21 of the water discharge head 12 is wiped by the wiper mechanism 32 is performed to wipe water off the water nozzle surface 21.

Figure 5B:
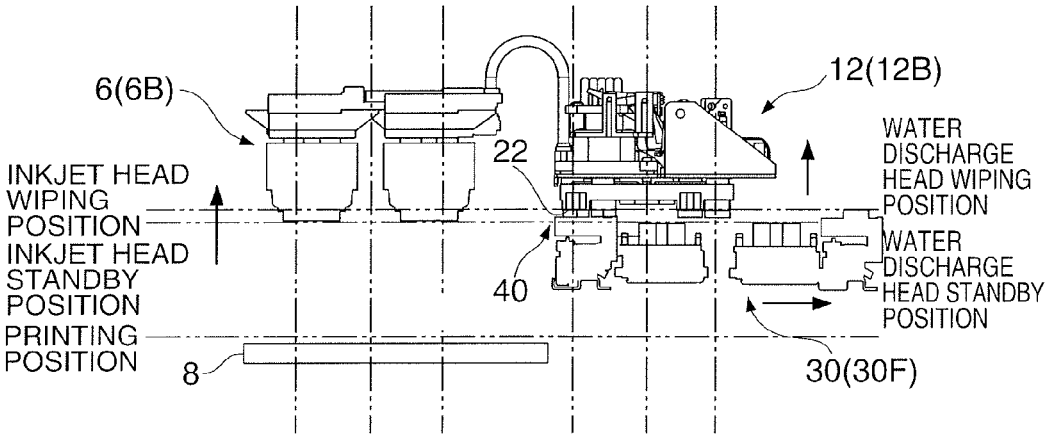

More specifically, as shown in FIG. 5B, the control unit 55 drives the first carriage moving mechanism 26 after printing ends and sets the inkjet head 6 to the inkjet head standby position 6B. The control unit 55 also drives the second carriage moving mechanism 27 to position the water discharge head 12 to the water discharge head wiping position 12B. At the same time the control unit 55 drives the maintenance unit carriage moving mechanism 50 and moves the maintenance unit 30 to the sixth maintenance position 30F, positioning the first wiper mechanism 40 directly below the first water nozzle surface 22 of the water discharge head 12.

Figure 5C:
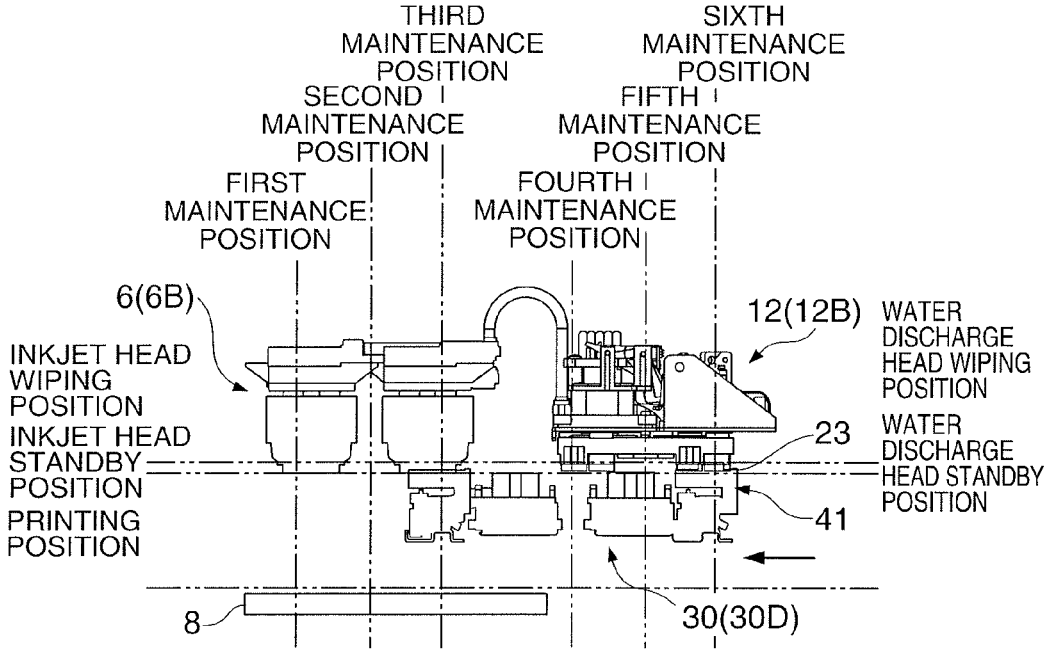
Figure 5D:
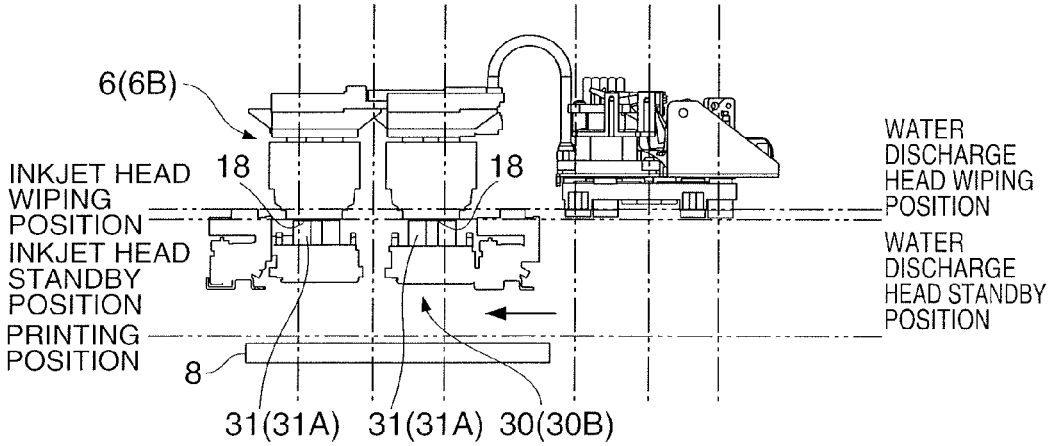

When the water discharge head 12 is at the water discharge head wiping position 12B, the height of the water nozzle surface 21 of the water discharge head 12 is at the height where the distal end of the wiper blade 42 of the first wiper mechanism 40 set to the sixth maintenance position 30F can contact the ink nozzle surface 18 of the water discharge head 12. The control unit 55 therefore drives the wiper moving mechanism 46 to wipe the first water nozzle surface 22 by means of the wiper blade 42. Then, as shown in FIG. 5C, the control unit 55 drives the maintenance unit carriage moving mechanism 50, moves the maintenance unit 30 to the fourth maintenance position 30D, and positions the second wiper mechanism 41 directly below the second water nozzle surface 23 of the water discharge head 12. The control unit 55 then drives the second wiper mechanism 41 and wipes the second water nozzle surface 23 by means of the wiper blade 42.

When the wiping operation in which the wiper mechanism 32 wipes the water nozzle surface 21 of the water discharge head 12 ends, the control unit 55 moves the maintenance unit 30 to the second maintenance position 30B and positions the cap 31 to the capping position 31A as shown in FIG. 5(*d*). As a result, the ink nozzle surface 18 of the inkjet head 6 is covered by the cap 31.

Ink Nozzle Surface Wiping Operation and Flushing Operation

The flushing operation and the wiping operation of the ink nozzle surface 18 by the wiper mechanism 32 are described next with reference to FIG. 6. FIG. 6 describes the positions of the head unit 10 and the maintenance unit 30 in the wiping operation and the flushing operation.

Figure 6A:
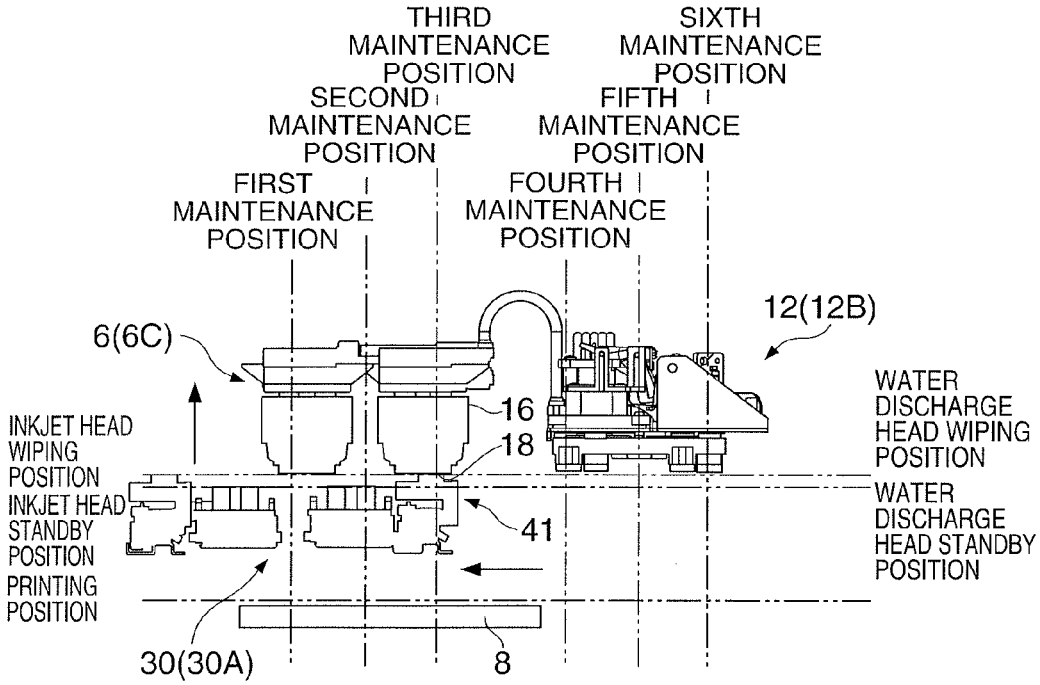
FIG. 6A, FIG. 6B, and FIG. 6C describe movements of the head unit and the maintenance unit during the wiping operation and the flushing operation.

When wiping the ink nozzle surface 18 by means of the wiper mechanism 32 is required, the water supply operation in FIG. 5A and the water nozzle 20 wiping operation in FIGS. 5B and C are first performed consecutively. Then, as shown in FIG. 6A, the control unit 55 drives the first carriage moving mechanism 26 and sets the inkjet head 6 to the inkjet head wiping position 6C. The control unit 55 then drives the maintenance unit carriage moving mechanism 50 and moves the maintenance unit 30 to the first maintenance position 30A, and positions the second wiper mechanism 41 directly below the second inkjet head 16.

The height of the inkjet head wiping position 6C of the inkjet head 6 is the height at which the distal end of the wiper blade 42 of the second wiper mechanism 41 can contact the ink nozzle surface 18 of the second inkjet head 16 when the maintenance unit 30 is moved to the first maintenance position 30A. As a result, the control unit 55 drives the wiper moving mechanism 46 and wipes the ink nozzle surface 18 by means of the wiper blade 42.

Figure 6B:
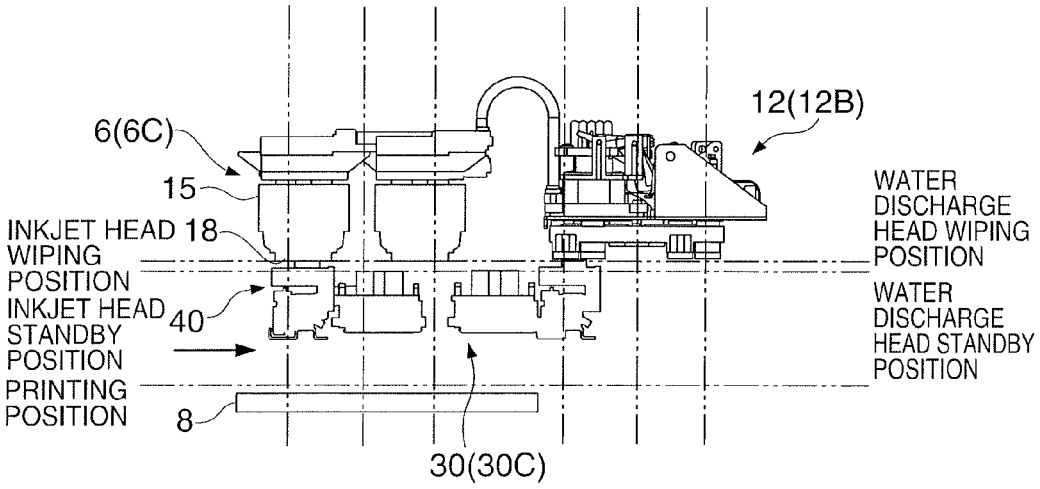

In addition, as shown in FIG. 6B, the control unit 55 drives the maintenance unit carriage moving mechanism 50 and moves the maintenance unit 30 to the third maintenance position 30C. The maintenance unit carriage moving mechanism 50 also positions the first wiper mechanism 40 directly below the ink nozzle surface 18 of the first inkjet head 15, and then drives the wiper moving mechanism 46 to wipe the ink nozzle surface 18 of the first inkjet head 15 with the wiper blade 42. Note that the ink nozzle surface 18 of the second inkjet head 16 may be wiped after wiping the ink nozzle surface 18 of the first inkjet head 15 in the wiping operation.

Figure 6C:
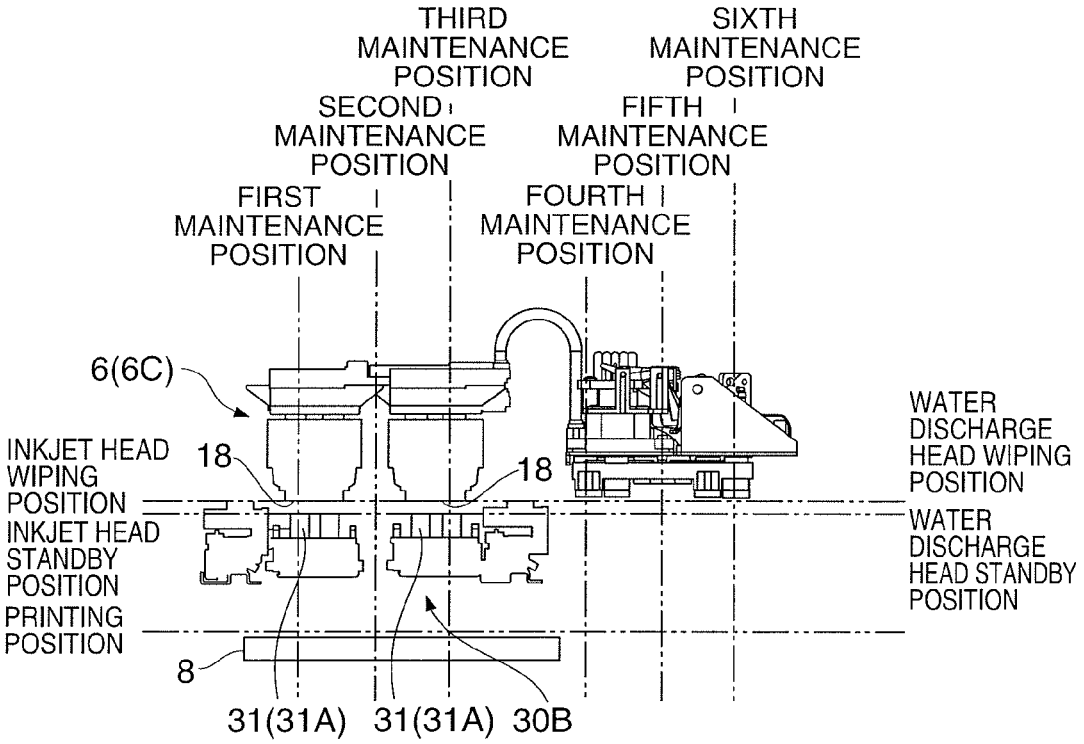

The flushing operation that discharges ink from the ink nozzles 17 to the cap 31 in order to suppress ink nozzle 17 clogging is described next. As shown in FIG. 6C, the control unit 55 drives the first carriage moving mechanism 26 and sets the inkjet head 6 to the inkjet head wiping position 6C. The control unit 55 also drives the maintenance unit carriage moving mechanism 50, moves the maintenance unit 30 to the second maintenance position 30B, and sets the cap 31 to the capping position 31A directly below the ink nozzle surface 18 of the inkjet head 6. Because this sets the inkjet head 6 opposite the cap 31, the control unit 55 discharges ink from the inkjet head 6.

A preferred embodiment of the invention is described above, and various modifications thereof are possible without departing from the scope of the invention. Some examples of such variations are described below.

(1) Water is supplied from the water discharge head 12 to the cap 31 in the embodiment described above, but a liquid other than water could be used to moisturize the inside of the cap 31.

(2) The inkjet head 6 and the pump mechanism 11 and water discharge head 12 are mounted on separate carriages in the embodiment described above, but these could be mounted on the same carriage and moved vertically together.

The invention claimed is:

1. An ink nozzle surface wiping method using a wiper blade, the method comprising:

covering an ink nozzle surface of an inkjet head in which the ink nozzle is formed, when the inkjet head is in the standby position;

sealing a cap using a cap sealing member, the cap sealing member having a liquid nozzle surface, when the inkjet head is in the printing position;

discharging a moisturizing liquid from a liquid nozzle and moisturizing an ink absorber when the cap is sealed; and wiping the liquid nozzle surface using the wiper blade.

2. The wiping method according to claim 1, the method further comprising:

wiping the ink nozzle surface of the inkjet head using the wiper blade.

3. The wiping method according to claim 1, the method further comprising:

moving the wiper blade between a first position where wiping the liquid nozzle surface of the cap sealing member is possible, and a second position where wiping the ink nozzle surface of the inkjet head is possible.

4. The wiping method according to claim 2, the method further comprising:

moving the cap between a capping position covering the ink nozzle surface of the inkjet head, and a sealed position where the cap is sealed by the cap sealing member; and performing, in order, moving the cap to the sealed position, discharging the moisturizing liquid from the liquid nozzle, moving the wiper mechanism to the first position, wiping the liquid nozzle surface by means of the wiper blade, moving the wiper mechanism to the second position, and wiping the ink nozzle surface by means of the wiper blade.

* * * * *